US006837132B1

(12) United States Patent
MacDonald

(10) Patent No.: US 6,837,132 B1
(45) Date of Patent: Jan. 4, 2005

(54) PAPER JAM REMOVAL TOOL FOR USE IN PAPER SHREDDERS

(76) Inventor: Herbert MacDonald, 360 Oaklyn Rd., Coatesvlle, PA (US) 19320

( * ) Notice: Subject to any disclaimer, the term of this patent is extended or adjusted under 35 U.S.C. 154(b) by 326 days.

(21) Appl. No.: 10/215,826

(22) Filed: Aug. 9, 2002

(51) Int. Cl.[7] ..... B25B 33/00
(52) U.S. Cl. ..... 81/488; 294/1.1; 294/26
(58) Field of Search ..... 81/488, 15.9; 244/1.1, 244/2, 26

(56) References Cited

U.S. PATENT DOCUMENTS

| | | | | | |
|---|---|---|---|---|---|
| 806,096 | A | * | 12/1905 | Bass | 294/26 |
| 1,088,005 | A | * | 2/1914 | Boughton | 294/1.1 |
| 1,739,347 | A | * | 10/1929 | Dymond | 294/26 |
| 3,242,540 | A | * | 3/1966 | Mitchell | 294/26 |
| 3,682,550 | A | | 8/1972 | Samuels et al. | 355/133 |
| 4,206,561 | A | * | 6/1980 | Wong et al. | 81/488 |
| 4,873,897 | A | * | 10/1989 | Williams | 81/15.9 |
| 4,955,647 | A | * | 9/1990 | Alfredson | 294/26 |
| 5,029,921 | A | * | 7/1991 | Houghton et al. | 294/26 |
| 5,318,229 | A | | 6/1994 | Brown | 241/34 |
| 5,339,473 | A | * | 8/1994 | Crist | 81/488 |
| 5,573,291 | A | * | 11/1996 | Raupp et al. | 294/1.1 |
| 6,003,914 | A | | 12/1999 | Brisbin | 294/26 |
| 6,007,124 | A | * | 12/1999 | Thies, Jr. | 294/26 |

* cited by examiner

*Primary Examiner*—James G. Smith
(74) *Attorney, Agent, or Firm*—Goldstein Law Offices, P.C.

(57) ABSTRACT

A paper jam removal tool, for use in clearing jammed paper from a paper shredder, constructed of a single length of wire having a first end and a second end. The first end of the tool leads sequentially into a first laterally extending portion, a first u-bend, a second laterally extending portion, a second u-bend, and a third laterally extending portion. The third laterally extending portion terminates at a central loop portion which wraps around the first and second lateral portions, and finally extends away from the laterally extending portions, perpendicularly thereto, forming a poker portion. The laterally extending portions and their associated u-bends form the handle of the tool. The poker portion of the tool extends perpendicularly from the handle portion and is used to push jammed paper through the blades of the paper shredder, thereby allowing for the continued operation of the paper shredder.

2 Claims, 3 Drawing Sheets

PAPER JAM REMOVAL TOOL FOR USE IN PAPER SHREDDERS

BACKGROUND OF THE INVENTION

1. Field of the Invention

The present invention relates to a tool which is used to remove pieces of paper which frequently become lodged within a paper shredder during the operation thereof.

2. Description of Related Art

A paper shredder is commonly employed in offices to allow safe disposal of sensitive documents. Accordingly, a series of closely positioned parallel blades cut paper inserted therein into fine strips, which are quickly disassociated from each other, thus rendering the document unreadable.

However, due to the close proximity of the blades to each other, it is common for a piece of paper, or a few pieces of paper to become lodged between the blades, and "jam" the machine. Often, until the jam is cleared, the shredder cannot be used. However, once again, because the blades are positioned so closely together, it is not easy to reach the lodged paper to clear the jam. Further, because modern paper shredders are designed with safety in mind, they are intentionally made so that the blades are relatively inaccessible. In this regard, there is a need for a tool which is easily handled, yet is capable of reaching and clearing a paper jam from a conventional shredder.

Various tools have been disclosed in the prior art, each having been devised to meet a particular purpose, or fulfill a particular need. For example, U.S. Pat. No. 6,003,914 to Brisbin appears to show a tool comprised of a shaft and a hook, for removing packing cotton from a bottle. However, this tool terminates in a hook and therefore could not be easily used for pushing jammed paper away from the blades of a paper shredder.

U.S. Pat. No. 3,682,550 to Samuels appears to show a photocopy machine with a reversing drive. This device allows for manual reversing of the normal direction of all the feed rollers of the photocopy machine, thereby enabling the release of a copy paper jam. However, this device is complex and expensive and is not specifically constructed for use in a paper shredder. In addition, Samuels is useless to help clear paper jams from existing office machines.

U.S. Pat. No. 5,318,229 to Brown appears to show a paper shredder with a stop mechanism. The stop mechanism functions to protect the blades of a paper shredder by detecting the approach of metal objects. This patent does not address the problem of freeing the shredder from jams once they have occurred.

While these units may be suitable for the particular purpose employed, or for general use, they would not be as suitable for the purposes of the present invention as disclosed hereafter.

SUMMARY OF THE INVENTION

It is an object of the invention to provide a tool which may be used to remove paper which frequently becomes jammed in a paper shredder during its routine operation. Accordingly, the tool has a handle portion which is held by the user and a narrow poker portion extending at a right angle from the handle portion which easily fits into the narrow openings that are present in most paper shredders in order to push the paper jams away from the blades of a paper shredder.

It is a further object of this invention to provide a tool which is easy to use. Accordingly, the user simply grasps the handle portion of the tool and pushes the poker portion towards an existing paper jam. Use of the tool requires no special expertise or directions.

It is a further object of this invention to provide a tool for freeing paper jams that requires no maintenance and is inexpensive to manufacture. Accordingly, the tool is constructed from a single piece of metal at a low cost and will last indefinitely.

The invention is a paper jam removal tool, for use in clearing jammed paper from a paper shredder, constructed of a single length of wire having a first end and a second end. The first end of the tool leads sequentially into a first laterally extending portion, a first u-bend, a second laterally extending portion, a second u-bend, and a third laterally extending portion such that the first, second, and third laterally extending portions extend substantially parallel to each other. The third laterally extending portion then terminates at a central loop portion which wraps around the first and second lateral portions for two full turns, and finally extends away from the laterally extending portions, perpendicularly thereto, forming a poker portion which terminates at the second end of the length of wire. The laterally extending portions and their associated u-bends form the handle of the tool and can be easily grasped in the palm of a user's hand thereby allowing the poker portion to extend between the user's fingers and away from the user. The poker portion of the tool functions as a probe and is used to push jammed paper through the blades of the paper shredder, thereby allowing for the continued operation of the paper shredder.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
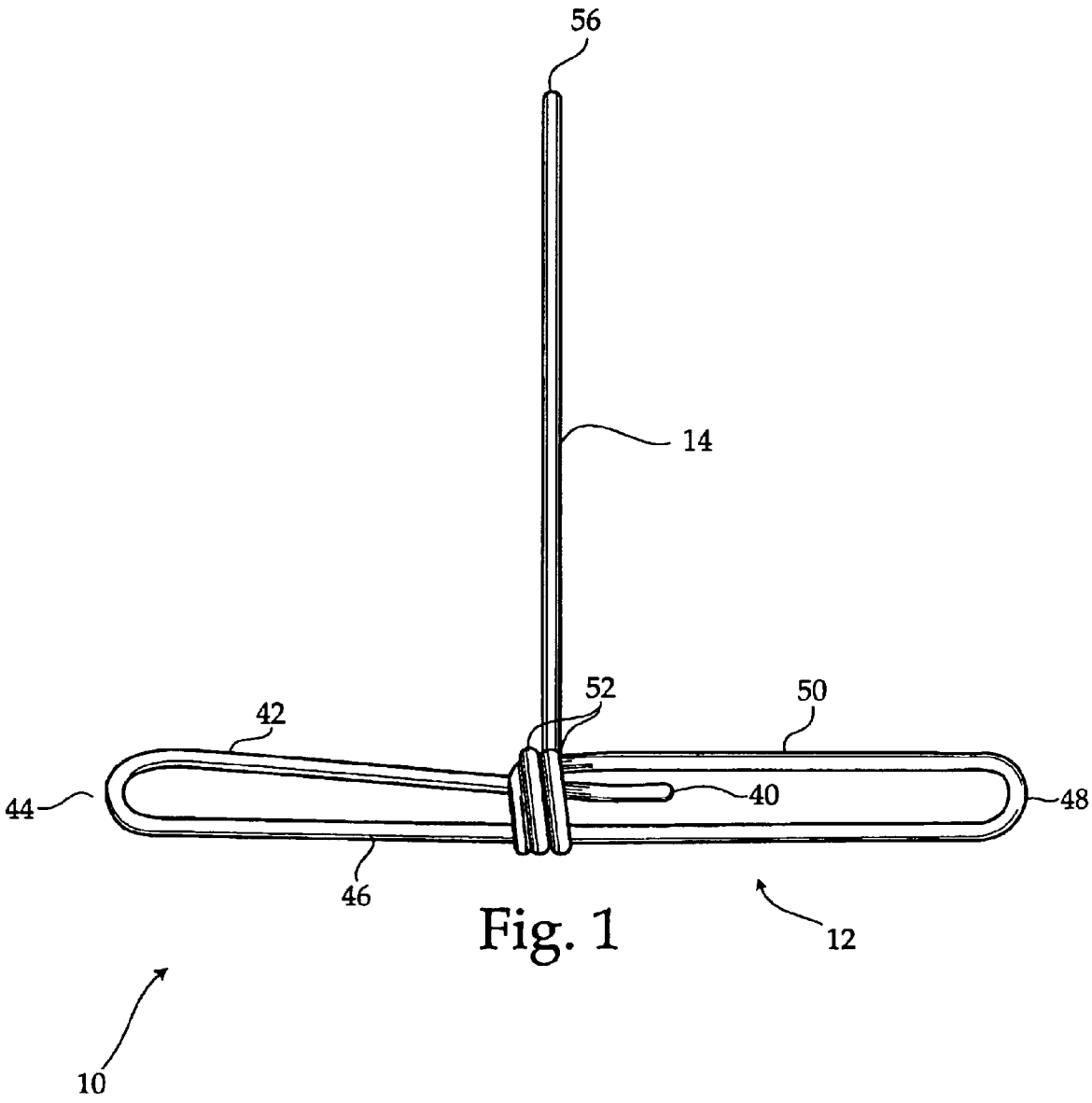
FIG. 1 is a side view of the tool showing the poker portion extending at a right angle from the handle portion.

FIG. 1 illustrates a side view of the paper jam removal tool 10. The tool 10 is generally constructed from a single piece of 12-gauge wire having two ends, namely a first end 40 and a second end 56. The tool 10 possesses three laterally extending portions: a first laterally extending portion 42, a second laterally extending portion 46, and a third laterally extending portion 50 which extend substantially parallel to one another. The tool 10 also has a central loop portion 52 which extends from the third laterally extending portion 50 and which then wraps around the first and second lateral portions 42 and 46. A poker portion 14 extends from the central loop portion 52, perpendicularly from the first laterally extending portion 42, the second laterally extending portion 46, and the third laterally extending portion 50, and terminates with the second end 56.

The first end 40 of the tool 10 helps form a handle portion 12 of the tool. The first end 40 is perpendicular to the second end 56 of the tool. The first end 40 begins the first laterally extending portion of the tool 42 which then extends into the first u-bend 44. The first u-bend 44 terminates with the second laterally extending portion 46 of the tool, which extends along the length of the entire handle portion 12 of the tool 10. Accordingly, the second laterally extending portion 46 extends past the first end 40, and is substantially twice the length of the first laterally extending portion 42. The second laterally extending portion 46 leads into the second u-bend 48 which itself extends into the third laterally extending portion 50. This third laterally extending portion 50 terminates at the central loop portion 52, adjacent to the first end 40. The central loop portion 52 comprises a wrapping of the wire two full turns (720 degrees) around both the first laterally extending portion 42 and the second laterally extending portion 46. The loop portion 52 then directly leads into the poker portion 14, which terminates at the second end 56.

Figure 2:
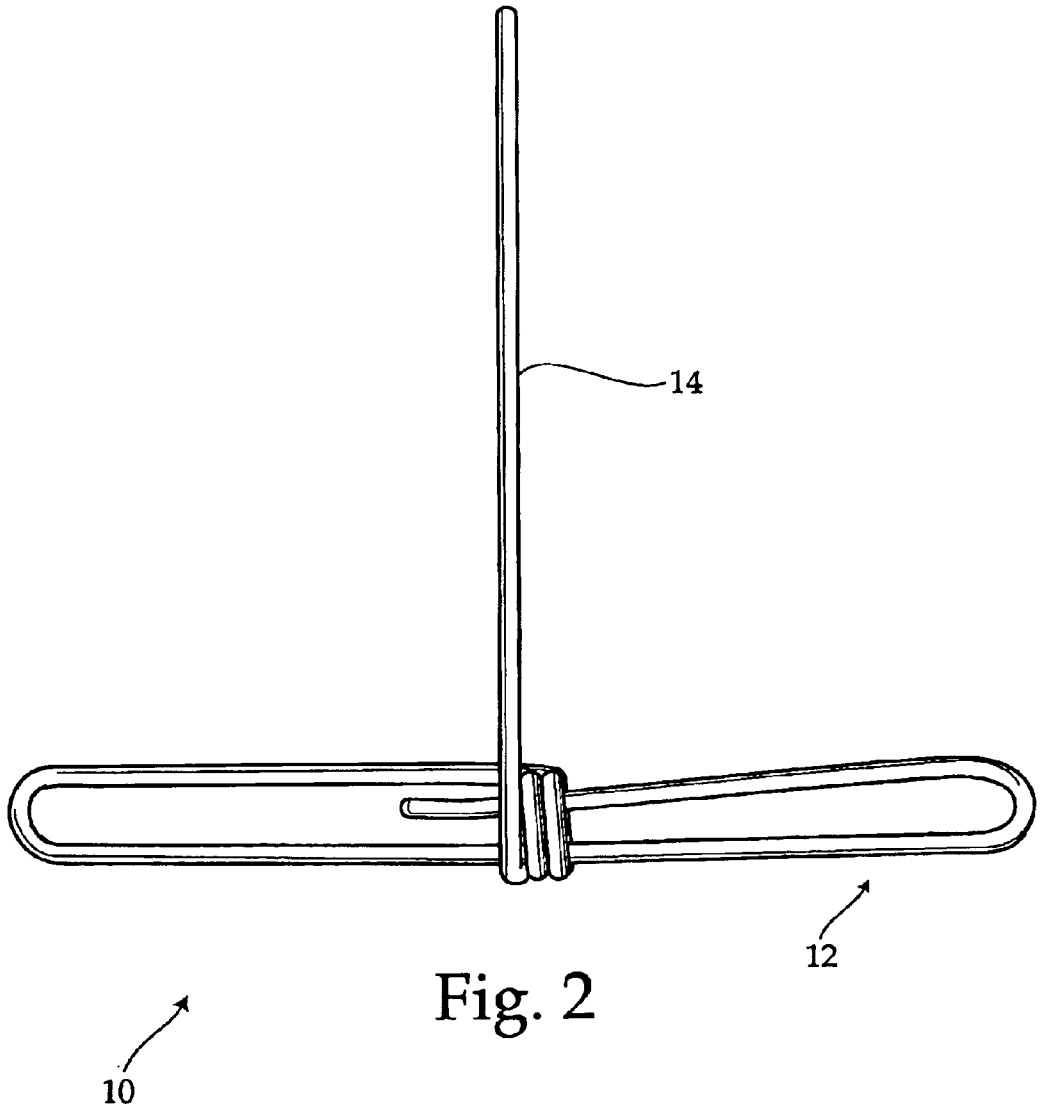
FIG. 2 is a side view of the tool, showing an opposite side thereof compared to FIG. 1.

FIG. 2 illustrates a side view of the invention 10 opposite from FIG. 1, further illustrating how the handle portion 12 and poker portion 14 are created by bending the wire.

Figure 3:
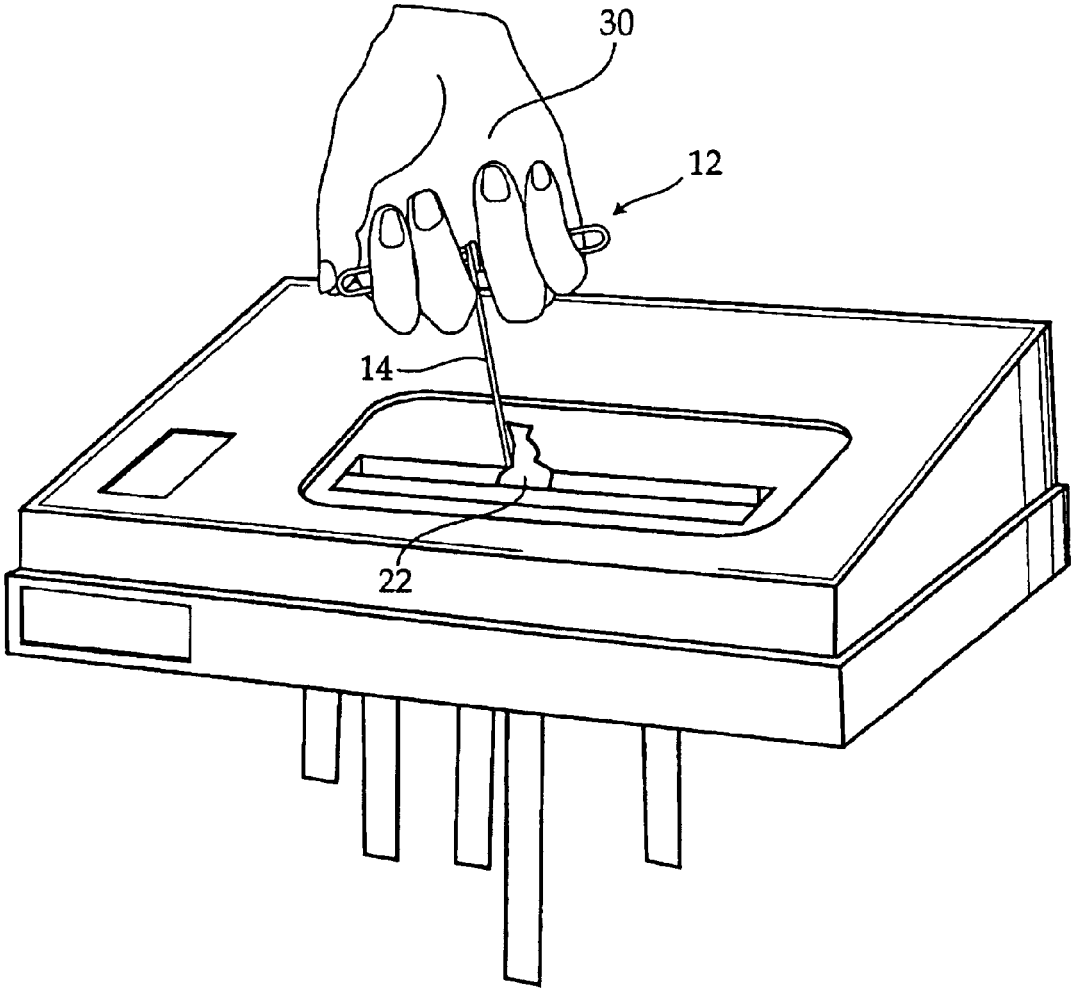
FIG. 3 is a side view of the tool with its handle portion being grasped in the palm of the user and with the poker portion extending away from the user and towards an existing paper jam in the paper shredder.

FIG. 3 illustrates the tool 10 in use by a user, having a hand, the hand having a palm 30. The tool 10 is being used on a shredder, having jammed paper 22 lodged therein. As illustrated, the user grasps the handle portion 12 of the tool firmly in the palm of the hand 30, with the poker portion 14 extending between the third and fourth (middle and ring) fingers and extending away from the hand. The user then positions the poker portion 14 so as to contact the paper jam 22 and then pushes the tool 10 against the paper jam 22 and through the blades within the shredder.

Pushing the jammed paper through the blades of the paper shredder effectively clears the jammed paper and allows the shredder to resume its operation.

In conclusion, herein is presented a tool which may be easily used to remove paper jams from paper shredding machines. The invention is illustrated by example in the drawing figures, and throughout the written description. It should be understood that numerous variations are possible, while adhering to the inventive concept. Such variations are contemplated as being a part of the present invention.

What is claimed is:

1. A tool for removing paper jams, for use with an office machine having a paper feeding portion having a narrow opening, where jammed paper is often present, comprising:

a single piece of wire, having a first and a second end and which is bent, such that it further has:

a) a first laterally extending portion, extending from the first end of the tool, b) a first u-bend, extending from the first laterally extending portion;

c) a second laterally extending portion, extending from the first u-band, substantially parallel to the first laterally extending portion and extending beyond the first end of the tool;

d) a second u-bend, extending from the second laterally extending portion fully opposite from the first u-bend;

e) a third laterally extending portion, extending from the second u-bend substantially parallel to the first and the second laterally extending portions;

f) a central loop portion extending from the third laterally extending portion and wrapping around the first and second laterally extending portions; and g) a poker portion, extending from the central loop portion, substantially perpendicular to first, second, and third laterally extending portions, the poker portion terminating in the second end such that the first, second and third laterally extending portions are grasped as a handle, and the poker portion is inserted into the office machine to clear jammed paper.

2. A method of using the paper jam remover of claim 1, for removing jammed paper from the office machine, by a user having a hand having a palm, third, and fourth fingers, comprising the steps of:

a) grasping the first, second, and third laterally extending portions of the tool in the palm of the user's hand with the poker portion extending outward and away from the palm of the user's hand, between the third and fourth fingers;

b) inserting the poker portion into the office machine against the jammed paper; and c) clearing the jammed paper from the machine by pushing the poker portion of the tool against the jammed paper and away from the user.

* * * * *